United States Patent [19]

Okada et al.

[11] 3,952,540

[45] Apr. 27, 1976

[54] APPARATUS FOR COOLING GOODS BY CONTACTING THE GOODS WITH LOW TEMPERATURE GAS

[75] Inventors: Nobuhiko Okada, Nara; Shunroku Yamashita, Takatsuki, both of Japan; Teikoku Sanso Kabushiki Kaisha, 03, Tokyo, both of Japan

[73] Assignees: Osaka Gas Kabushiki Kaisha, Osaka; Teikoku Sanso Kabushiki Kaisha, Tokyo, both of Japan

[22] Filed: Oct. 30, 1973

[21] Appl. No.: 410,998

[30] Foreign Application Priority Data

Oct. 31, 1972 Japan ..... 47-109709
Sept. 27, 1973 Japan ..... 48-109035

[52] U.S. Cl. ..... 62/374; 62/380; 62/65

[51] Int. Cl.[2] ..... F25D 17/02

[58] Field of Search ..... 62/63, 380, 382, 374, 62/375, 65

[56] References Cited

UNITED STATES PATENTS

| | | | |
|---|---|---|---|
| 1,955,669 | 4/1934 | Botz | 62/380 |
| 2,059,970 | 11/1936 | Robillard | 62/63 |
| 2,153,742 | 4/1939 | Conn | 62/63 X |
| 2,275,588 | 3/1942 | Greene | 62/380 |
| 2,685,176 | 8/1954 | Berch et al. | 62/380 |
| 2,787,141 | 4/1957 | Julius | 62/63 |
| 3,258,935 | 7/1966 | Ross | 62/374 |
| 3,403,527 | 10/1968 | Berreth et al. | 62/65 X |
| 3,413,818 | 12/1968 | Pelmulder | 62/374 |
| 3,688,518 | 9/1972 | Goltsos | 62/380 |
| 3,708,995 | 1/1973 | Berg | 62/380 X |
| 3,831,389 | 8/1974 | Lipona | 62/63 |

*Primary Examiner*—William F. O'Dea
*Assistant Examiner*—Ronald C. Capossela
*Attorney, Agent, or Firm*—Edwin E. Greigg

[57] ABSTRACT

An apparatus for cooling goods by contacting the goods with low temperature gas while transferring intermittently the goods. The low temperature gas is circulated forcedly in a section while being flowed in a direction reverse to the direction of transferring goods.

10 Claims, 7 Drawing Figures

APPARATUS FOR COOLING GOODS BY CONTACTING THE GOODS WITH LOW TEMPERATURE GAS

BACKGROUND OF THE INVENTION

The present invention relates to a an apparatus for cooling, wherein goods are transferred with the goods arranged along the transferring route and low temperature gas is flowed in a direction reverse to the direction of transferring goods, and thereby the goods are cooled by contacting them with the low temperature gas. In the present invention, freezing is also denominated cooling.

Such a method of and an apparatus for cooling are utilized widely for the purposes such as for preserving food stuffs, hardening plastic substances such as rubber, plastics and the like to pulverize and cooling metal in heat treatment process.

A method and an apparatus of the type mentioned above, which have been proposed or adopted heretofore are described briefly in the sentences which follow. Namely, low temperature gas was flowed substantially in parallel and in a direction reverse to the direction of transferring goods or low temperature gas was flowed across the goods transferring route several times while the crossing position was moved slowly in a direction reverse to the direction of transferring goods. That of such former type, however, could not satisfy simultaneously two requirements to shorten the goods transferring route and fully make use of the cooling energy of low temperature, gas being high in cost per unit heat.

That is, in cooling obtained by contacting goods with low temperature gas, convection heat transmission is most effective, and in convection heat transmission, cooling of goods by means of low temperature gas is affected by the heat transfer rate and the contacting time interval when the temperature difference between both is constant. The heat transfer rate is affected by the relatice speed of goods and low temperature gas, and the greater the relative speed is, the larger the heat transfer rate is, and also the longer the contact time interval is, the larger the heat transferred is.

Accordingly, to increase the heat transferred between goods and low temperature gas, when the relative speed between the goods and the low temperature gas is to be increased while the time interval of contact between the goods and the low temperature gas is to lengthened, the length of the goods transferring route must increase and consequently the size of the apparatus and construction cost is increased. On the other hand, as the goods transferring route is reduced, the efficiency of untilzing the cooling energy of low temperature gas is decreased, the cooling energy, being high in cost per unit, heat is not efficiently consumed.

The present invention, taking in consideration the problems above mentioned, has carried out the improvement of the method and apparatus for cooling.

SUMMARY OF THE INVENTION

A method according to the present invention of cooling goods by contacting the goods with low temperature gas comprises the steps of; transferring the goods intermittently with the goods arranged along the transferring route, receiving the goods on the transferring route distributedly into at least one cooling space and at least one precooling space located in a direction reverse to said direction of transferring goods with respect to the cooling space, at least while said transference of goods is stopped, supplying low temperature gas into said cooling space, supplying low temperature gas in the interior of the cooling space into said precooling space, and circulating forcedly gas in the interior of each of said cooling and precooling spaces.

The, the apparatus according to the present invention for cooling goods by contacting the goods with low temperature gas comprises, a conveying means for transferring the goods intermittently with the goods arranged along the transferring route, means for forming at least one cooling space and at least one precooling space located in a direction reverse to the direction of transferring goods with respect to the cooling space, the cooling and precooling spaces receiving distributedly the goods in the conveying means arranged in the direction of the transferring route at least with the conveying means stopped, means for supplying low temperature gas into at least the cooling space, a conduit means for supplying the temperature gas within the precooling space, and means for circulating forcedly gas within each of the cooling and precooling spaces.

In short, the method and apparatus according to the present invention are characterized in the goods are transfered intermittently, the goods are received distributedly into the cooling and precooling spaces with the transference of goods stopped, the low temperature gas is circulated forcedly in the interior of each of the spaces, and the low temperature gas supplied from the cooling space into the precooling space.

That is, by circulating forcedly the low temperature gas within each of the spaces, the heat transfer rate between goods and low temperature gas may be increased, and as the low temperature gas is circulated in the interior of each of the spaces, the time interval of contact between the goods and the low temperature gas may be lengthened compared with the length of the goods transferring route and the relative speed of the goods and the low temperature gas, whereby the goods transferring route is shortened and the cooling energy of the low temperature gas is utilized as much as possible, these aims being accomplished simultaneously.

After all, both the upgrading of the coefficient of utilization of the cooling energy which is high in cost, and the economical construction cost and operating expense of the apparatus per se desired for industry have been carried out according to the present invention simultaneously.

An object of the present invention is to provide an apparatus for cooling goods economically.

Another object of the present invention is to provide an apparatus for cooling goods, feasible to upgrade the coefficient of utilization of the cooling energy of low temperature gas.

Further another object of the present invention is to provide an apparatus for cooling goods, feasible to the device.

Other objects and advantages will be come apparent from the statements hereunder.

DESCRIPTION OF THE PREFERRED EMBODIMENTS

Figure 1:
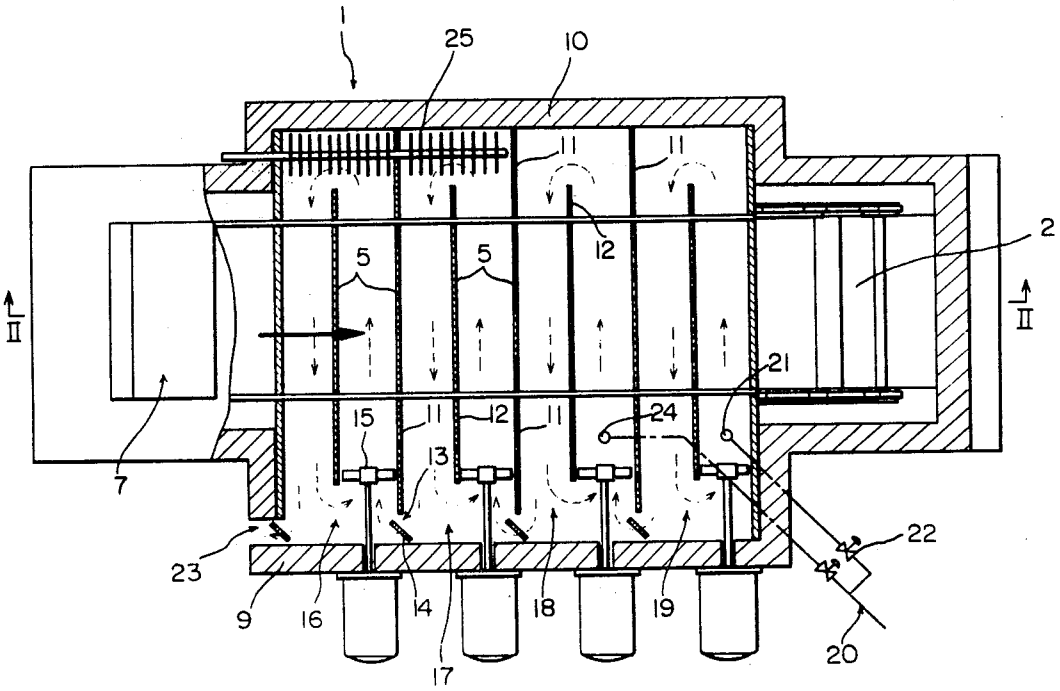
FIG. 1 is a view in plan partially broken, showing a first embodiment of the present invention.
Figure 2:
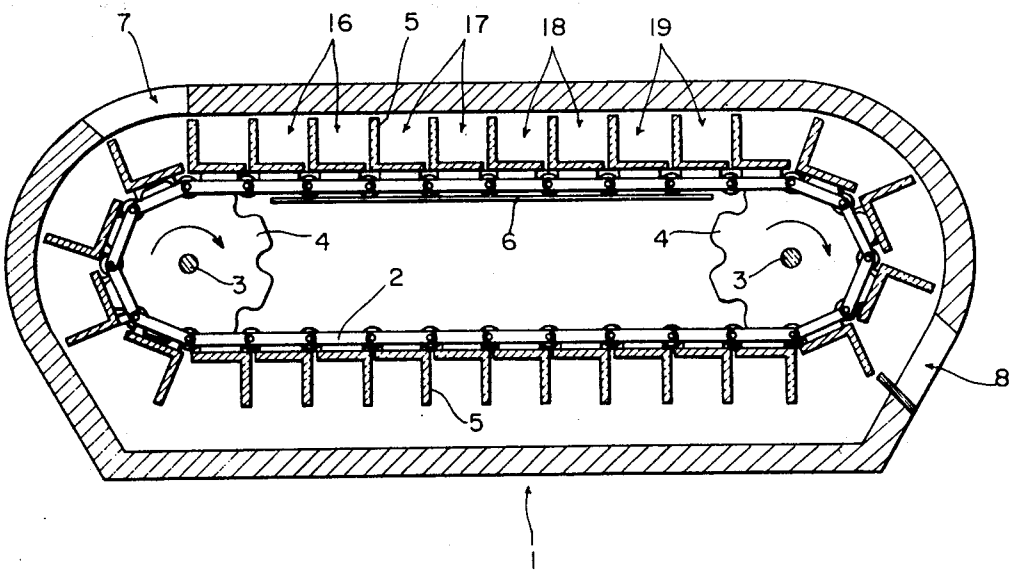
FIG. 2 is a view in section taken along the line II—II in FIG. 1.

The first embodiment is to be explained, reference being made to FIGS. 1 and 2.

An annular chain conveyor 2 is located in the interior of a housing 1 having insulating wall comprising a metal box filled with foaming styrol particles or the like. The chain conveyor 2 is propped with four sprochets 4 mounted in pairs respectively on two rotary shafts 3 pivoted substantially in parallel to one another on the housing 1. At least one of both rotary shafts 3 is preferably driven intermittently to turn through an angle at a substantially regular time interval, interlockedly by a driving means such as an electric motor having a program control unit. The chain conveyor 2 has a plurality of plate members 5 substantially perpendicular to the surface thereof to support the goods being cooled, and the intervals between the plate members 5 are substantially uniform. The chain conveyor 2 is moved a distance equal to the interval of the plate members 5 or about twice thereof by every rotation of said rotary shaft 3. Each of the plate members 5 is moved with the front end edge thereof neared uprightly to the inner wall surface of the upper portion of the housing 1, and thereby the space between the upper portion of the chain conveyor 2 and the upper wall surface of the housing 1 is partitioned in the direction of transferring goods. The upper portion of the chain conveyor 2 positioned is propped with guide rails 6 to prevent deflection due to the weight of goods or the like.

The goods supplied into the chain conveyor 2 through inlet 7 provided at one end of the housing 1 are transferred in a condition received distributedly in each of the small spaces and taken out through outlet 8 provided at the other end of the housing 1.

As shown in FIG. 1, both side wall portions 9, 10 of the housing 1 facing the space between the upper portion of the chain conveyor 2 and the upper inner surface of the housing 1 are arranged to protrude outwardly. In both the recessed portions formed in the interior of the housing 1 by the protrusion in wall portions 9, 10 are provided five first partition plate members 11 which are positioned at intervals substantially twice the distance and thus provide four alternate passageways for gas travel to and fro relative to the housing. And also, in the interiors of both the recessed portions are provided four second partition plates 12 positioned near to the middle of the interval of the first partition plates 11 adjacent to each other and a gap is formed between a side edge of the second partition plate 12 and the inner surface of the protruded wall portion 9 or 10. Three of the first partition plates 11 are provided in the recessed portions have openings 13 in the recessed portion on one side a rotary damper 14 for regulating the open area ratio of each of the openings 13 is fitted to each opening 13. In the recessed portion on the one side is provided an electric fan in each of the spaces divided by the first partition plates 11.

As shown in FIG. 2, with the chain conveyer stopped, each of the plate members 5 is positioned substantially in a plane with respect to the respective first partition plate 11 and also with respect to the respective second partition plate 12, and thereby four limited spaces 16, 17, 18, 19 are formed, which are formed to be disposed in a line in the direction of transferring goods with the plate members 5 and the first partition plates 11 and adjacent ones of which are communicated with each other through the opening 13. Out of the four limited spaces, the cooling space 19 located in the rear side with respect to the direction of transferring goods is provided with a main nozzle 21 convected to a pipe 20 for supplying, for example, low temperature liquified gas such as liquified nitrogen or low temperature nitrogen gas obtained by evaporating low temperature liquified nitrogen gas or gaseous body such as air cooled with cooling medium, etc., and thereby low temperature gas is supplied into the space 19 while the gas within the cooling space 19 is sent successively into the three precooling spaces 18, 17, 16 located nearer to the inlet than the cooling space 19 through the opening 13. By means of the action of the electric fans 15, the low temperature gas is circulated forcedly in the interiors of the cooling and precooling spaces 16, 17, 18 and 19 as shown with broken, arrowheaded lines in FIG. 1. The amount of the low temperature gas supplied through the main nozzle 21 per unit time is regulated with a control valve 22 provided in the low temperature gas supply pipe 20 correspondingly to the volume obtained by substracting the volume of goods from the space volume of each of the limit spaces, that is, the volume within the limited space so that the low temperature gas may be sent into next limited space in order after remaining in each of the limited spaces for a time interval required by the low temperative gas to transmit heat. Accordingly, the low temperature gas become in the condition of being sent into next limited space after several circulations in the interior of a limited space and thereby the miniaturization of the apparatus and the improvement of utilization factor of the cooling energy of low temperature gas may be carried out as goods are contacted with low temperature gas under a condition of a large relative speed therebetween compared with the length of the goods transferring route. The low temperature gas is discharged outside of the housing 1 from the cooling space 16 nearest to the inlet 7 through an exhaust port 23.

The temperature of each of the cooling space 19 and precooling spaces 16, 17, and 18 is set suitably according to the objective goods and the purpose of cooling, for example, the temperature within the cooling space 19 is set at −180° C and the temperature of the precooling spaces 16, 17, and 18 is maintained respectively at a substantially constant temperature of −140° C, −100° C, −50° C successively in the order from the cooling space 19. Such temperature controls the amount of the low temperature gas supplied from the main nozzle 21, the open area ratio of each of the dampers 14, the amount of the low temperature gas supplied from an auxiliary nozzle 24 provided in the precooling space 18, the cooling action of an auxiliary cooler 25 for the precooling spaces 16, 17 and etc.

The auxiliary cooler 25 has a pipe to pass through cooling medium such as Freon and the like and fins fixed to the pipe. In short, as for the gas within the precooling spaces 16, and 17 nearer to the inlet 7, cooling may be carried out without utilizing low temperature liquified gas being high in cost. Like this, running cost may be reduced by utilizing cooler having indirectly cooling function by means of cooling medium generally used in cooler and the like. The auxiliary nozzle 24 for the recooling spaces 16–18 and the auxiliary cooler 25 may be omitted, and also they may changed in arrangement.

When the intermittent transferrence of the chain conveyor 2 is stopped, each of the electric fans 15 is preferably operated automatically, and simultaneously low temperature gas is supplied from the nozzle 21 into the cooling space 19 and the low temperature gas is sent from the cooling space 19 successively into the precooling spaces 18, 17 and 16. And, the temperature of the gas within the cooling and precooling spaces 16, 17, 18, and 19 is preferably measured automatically, and when the temperature measured reaches a preset value and a prescribed time passes away, the electric fans 15 are automatically stopped and simultaneously the main nozzle 21 is closed, and the chain conveyor 2 is driven, and thereby the goods are sent successively to the lower temperature limited spaces and after being cooled to a preset temperature, are taken out from the outlet 8.

Figure 3:
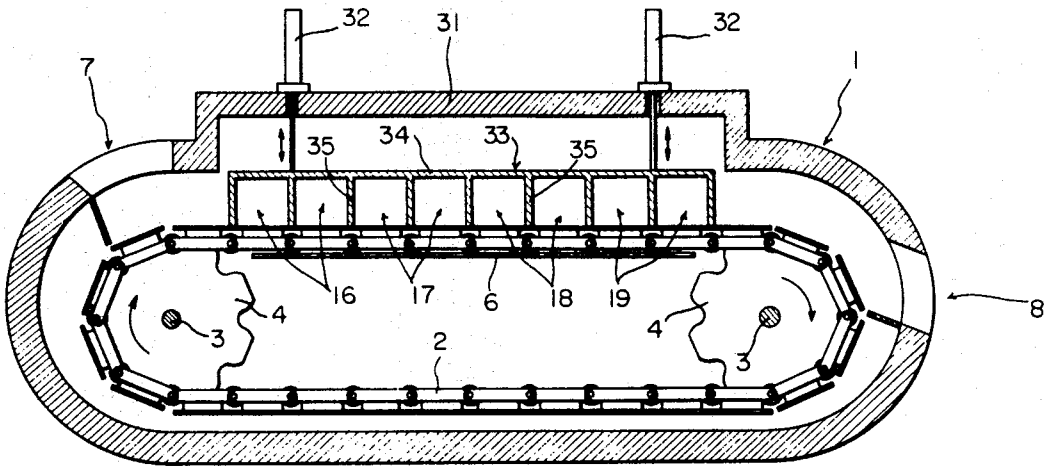
FIG. 3 is a view in longitudinal section, showing a second embodiment of the present invention.

The second embodiment is to be explained by referring to FIG. 3.

The apparatus of the second embodiment is obtained only by removing the plate members 5 from that shown in the first embodiment and providing protruded portion 31 projected outward from the housing 1 on the upper wall thereof while adding a partition member 33 changeable up and down in position by two hydraulic pressure cylinders 32 as shown in FIG. 3 and other structures and operations are same to those of the first embodiment, consequently by the structures and operations being common to both the first and second embodiments are omitted in description of FIG. 3, the reference numbers being conformed in both of these embodiments.

The partition member 33 has on upper wall 34 substantially equal in width to the chain conveyor 2 and extending substantially in parallel thereto, and a plurality of vertical walls 35 substantially vertically provided on the upper wall at the underside thereof, arranged at internals substantially equal to the plate members 5 and in the direction of transferring goods. When the partition member 33 is located in the upper position, the vertical walls 35 are retracted into the interior of the protruded upper wall portion 31 and never disturb the transference of goods, and when the flow control means including the horizontal partition member 33 is located in the lower position, the vertical walls 35 act as the plate member 5 and thereby four limited spaces are formed. With each structure, the space in the lower portion of the housing 1 may be made smaller, and thereby the amount of low temperature gas retained in the lower portion may be reduced, and the consumption of the low temperature gas may be also reduced.

Figure 4:
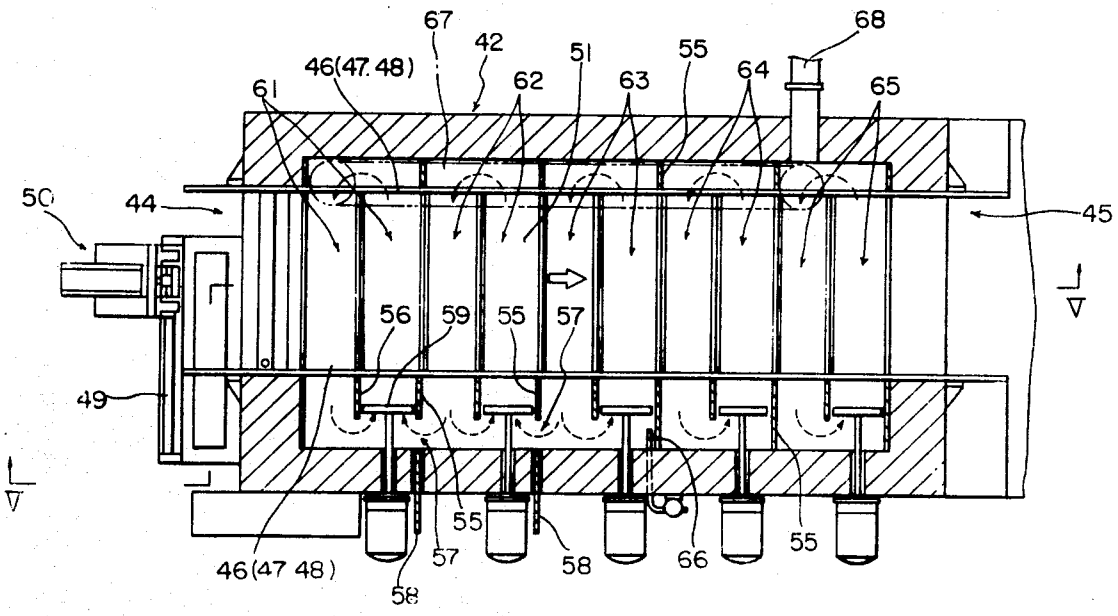
FIG. 4 is a view in plan partially broken, showing a third embodiment of the present invention.
Figure 5:
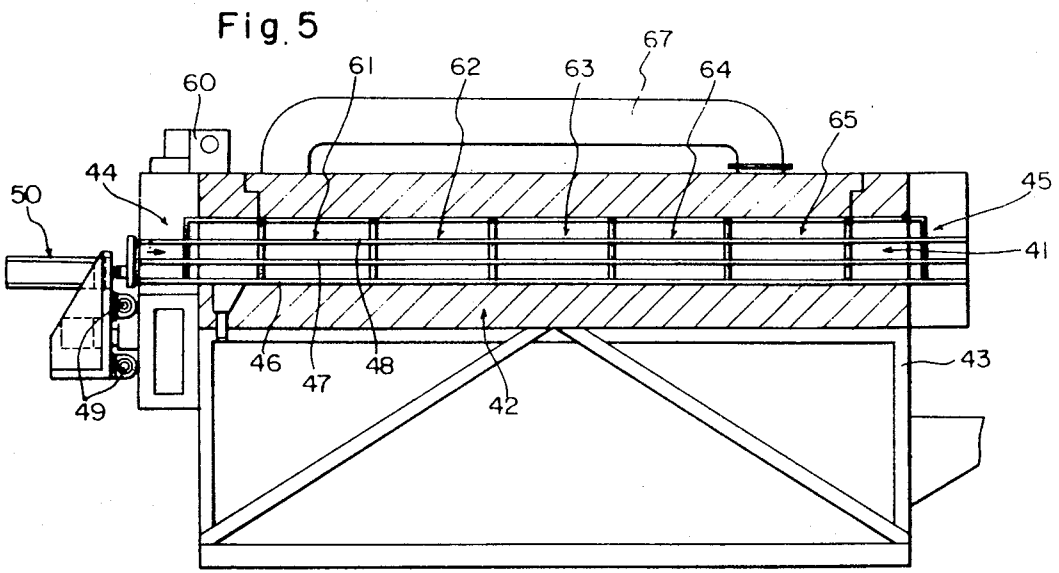
FIG. 5 is a view in section taken along the section line V—V in FIG. 4.
Figure 6:
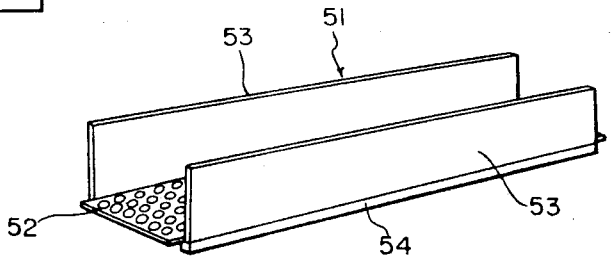
FIG. 6 is a oblique view, showing a tray.

The third embodiment is to be explained by referring to FIGS. 4, 5 and 6.

A housing 42 forming a tunnel 41 square in section with insulating wall is installed on a base 43. Throughout from the inlet 44 provided at one end of the housing 42 to the outlet 45 provided at other end thereof, three pairs of guide rails 46, 47, 48 are laid substantially horizontally. The first pair of guide rail 46 is positioned in the lower portion of the tunnel 41, the second pair of guide rail 47 is positioned at a height equal to about one third of the height of the inside of the tunnel 41 from the lower portion and the third pair of guide rail 48 is positioned at a height equal to about two third of the height of the inside of the tunnel 41 from the lower portion, respectively. At the side of the inlet 44 is provided a hydraulic pusher 50 held by the two guide rails 49 and changeable in position laterally with respect to the tunnel 41 along the guide rail 49. With the pusher 50 moved nearer to the side of the inlet 44, a plurality of trays 51 containing goods are supplied onto the first to third pairs of guide rails 46, 47 and 48 through the inlet 44 and the trays 51 are disposed vertically in three steps within the tunnel 41. The tray 51, as shown in FIG. 6, consist of a bottom plate 52 having small holes, side plates 53 disposed in the front and rear sides with respect to the direction of transferring goods within the tunnel and sealing members 54 attached to the lower ends of both side plates 53, the bottom plate 52 is protruded at both sides thereof from the side plate 53, and the protruded portion of the bottom plate 52 are rested on the pairs of guide rails 46, 47, 48. The trays 51 located vertically on three steps are pushed simultaneously into the tunnel 41 by the pusher 50 positioned about in the middle of the inlet 44, and the trays 51 supplied successively are transferred intermittently through the interior the tunnel 41 toward the outlet 45 while jostling one another. With one stroke of the pusher 50, the trays 51 transferred a distance nearly equal to the distance between both side plates 53 thereof or nearly twice that distance. And, the side plate 53 of the tray 51 may be one in number and the number of the step of tray 51 may be varied.

As shown in FIG. 5, there are formed gaps between the inner surface of both side walls of the housing 1 and the pair of the guide rails 46, 47 and 48 in the both gaps are provided respectively four first partition plates 55 with interval about twice the interval between both side plates 53 of the tray 51 thus, both gaps are divided respectively into five sections in the direction of transferring goods with the first partition plates 55. In the gap on one side are equipped five second partition plates 56 located nearly in the middle of the first partition plates 55, and there are gaps between one side edges of the second partition plates 56 and the inner surface of the side wall of the housing 42. Two first partition plates 55 located nearer to the inlet 44, out of the five first partition plates 55, having openings 57 in the gap on one side, sliding dampers 58 for regulating the open area ratio of the openings 57 are attached respectively for the openings 57. And, in the gap on the one side are fitted electric fans respectively in the space forward by dividing the gap with the first partition plates 55. The part designated by the numeral 60 is a device acting as the air curtain of the inlet 44.

With the trays 51 stopped, as shown in FIG. 4, the side plates 53 of the trays 51 are positioned substantially in a plane with respect to the first partition plates 55 and simultaneously substantially in a plane with respect to the second partition plates 56, and thereby five limited spaces 61, 62, 63, 64 and 65 are formed in the direction of transferring goods with the side plates 53 and the first partition plates 55. A main nozzle 66 to supply low temperature gas into the third limited space 63 counted from the inlet 44 is provided therein as mentioned referring to FIGS. 1 and 2, and the limited space 63 is used as cooling space. The low temperature gas supplied into the cooling space 63 is sent successively into the two limited spaces 62 and 61 acting as precooling space, positioned nearer to the inlet 44 than the cooling space 63, through the openings 57. The low temperature gas within the precooling space 61 nearest the inlet 44 is sent into the limited space 65 for uniformalizing temperature of goods nearest to the outlet 45 through a pipe 67, and is discharged outside of the housing 42 from the spaced 65 through a pipe 69. The second limited space 64 counted from the outlet 45 acts also space for uniformalizing temperature of goods. The low temperature gas is circulated forcedly as shown with dotted line in FIG. 4 in the cooling, precooling spaces 61, 62, 63 and 64, and the space for uniformalizing temperature 65 by means of the action of the electric fans 59 and thereby the miniaturization of the apparatus and the improvement of the utilization factor of the cooling energy of the low temperature gas may be accomplished as mentioned referring to FIGS. 1 and 2. And, when a system to slide the tray 51 like this is adopted, the volume of the space into which low temperature gas is supplied may be reduced to the least required for cooling goods, and thereby the consumption of the low temperature gas high in cost may be reduced and an economical running may be carried out, moreover, when pusher system is adopted like this, the means for transferring goods may be located in an area of room temperature, preferably there will be brought about no trouble of the transferring means due to refrigeration.

The regulation of the amount of the low temperature gas supplied into the cooling space 63 and the temperature control of the cooling and precooling spaces 61, 62 and 63, may be carried out as explained above, referring to FIGS. 1 and 2.

Figure 7:
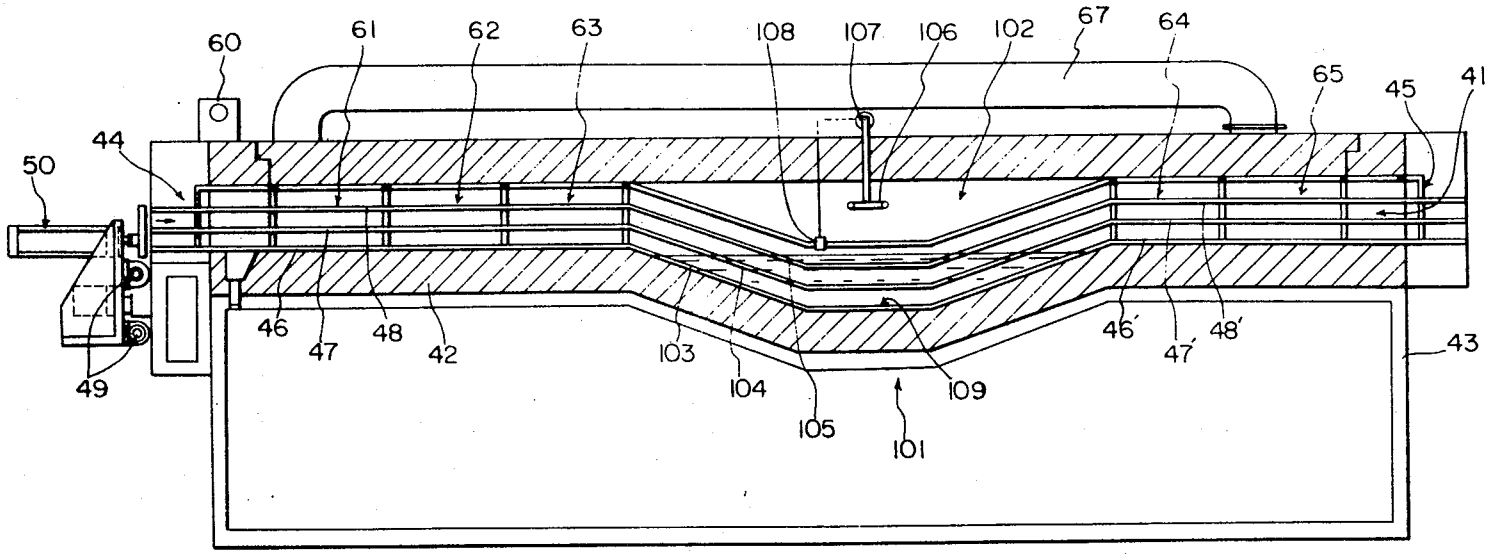
FIG. 7 is a view in longitudinal section, showing a four embodiment of the present invention.

The fourth embodiment is to be explained by referring to FIG. 7.

The apparatus of fourth embodiment is obtained only by positioning separately the cooling space 63 and the space 64 for uniformalizing temperature of the apparatus shown in third embodiment and adding a means 101 for soaking goods into low temperature liquified gas such as liquified nitrogen gas there between, and other parts and operations are similar to those of the third embodiment consequently, the description of these parts and functions being common to the third and fourth embodiments are omitted hereinbelow and the reference numbers are conformed.

The means 101 for soaking goods in low temperature liquified gas comprises a closed spaces 102 communicated with the cooling space 63 at one end thereof and with the space 64 for uniformalizing temperature at the other end thereof, three pairs of guide rails 103, 104 and 105 joined with the pairs of guide rails 46, 47, 48, on the side of the cooling space 63 at one ends thereof and with the pairs of guide rails 46′, 47′ and 48′ on the side of space 64 at the other ends thereof, a pipe 106 for supplying low temperature liquified gas into the closed space 102, a level controller 108 for opening and closing a valve 107 of the supply pipe 106 to maintain substantially constant the level of the low temperature liquified gas in the interior of the closed space 102. The inner surface 109 of the bottom wall forming the closed space 102, initially lowered from the cooling space 63 in the direction of transferring goods, then is substantially horizontal, continuously raises and reaches the space 64. The pairs of guide rails 103, 104 and 105 in the closed space 102 are all laid substantially in parallel to the inner surface 109 of the bottom wall of the closed space 102. The difference between the level of the horizontal portion of the inner surface 109 of the bottom wall of the closed space 102 and that of the inner surface, of the bottom of the cooling space 63 and the space 64 is over the height of three trays 51 piles up one over another. All of the trays 51 transferred from the cooling space 63 into the closed space 102 are soaked in the low temperature liquified gas reservoired in the closed space 102, and the low temperature liquified gas prevented from allowing out from the closed space 102 into the cooling space 63 and the space 64. In the fourth embodiment, it is advantageous to supply the gas evaporated within the closed space 102 into the cooling space 63.

The apparatus of the fourth embodiment is suitable for cooling to an extremely low temperature and a profit equal to that of the third embodiment may be obtained. The soaking means 101 in the fourth embodiment may be combined in the first and second embodiments.

As means for transferring goods intermittently, various well known means besides the embodied mode of illustrated first to fourth embodiments may be utilized.

As the precooling and cooling spaces, either is enough at least with one in number, and provision of the space for uniformalizing temperature of goods and soaking means on the number of them may be changed suitably in design.

The means for limiting the precooling and cooling spaces and on the space for uniformalizing temperature may be changed suitably in design.

As the means for supplying low temperature gas into the cooling space, various well known structures may be adapted.

As conduit means for supplying the low temperature gas in the interior of the cooling space into the precooling space, various well known structures may be adopted.

For circulating forcedly the gas in the interiors of the precooling and cooling spaces and the space for uniformalizing temperature of goods, various well known structure may be adopted.

The liue of circulation of gas in the interior of the precooling and cooling spaces and/or the space for uniformalizing temperature of goods may be in any direction with respect to the direction of transferring of goods.

What we claim is:

1. An apparatus for cooling goods through contact with a low temperature gas comprising, in combination:

a housing;

a conveying means mounted in said housing for intermittently transferring the goods in a substantially rectilinear direction through said housing;

wall means arranged substantially equidistantly in vertical relation to a goods transferring path through a space between an upper surface of said conveying means and an upper surface of said housing, said wall means being adapted to shift intermittently together with said conveying means;

recesses in said housing defined by outwardly protruding portions of two side walls thereof which face said space between an upper surface of said conveying means and an upper inner surface of said housing;

first and second partition means provided in said recesses in substantially parallel relation to and respectively at intervals twice those of said wall means, said first and second partition means being arranged alternatingly and equidistantly, said second partition means having oppositely disposed end portions adapted to stop short of said side walls to thereby form gaps between the said partitions and said side walls, said wall means being placed in alignment respectively with said first partition means and with said second partition means when said conveying means is standing still;

at least one precooling space and at least one cooling space defined by said wall means, said first partition means, and said housing, said cooling space being located forward of said precooling space with respect to a direction of transferring goods, said first partition means being provided with a passage for supplying a low temperature gas from said cooling space into said precooling space;

fan means provided in said cooling space and said precooling space respectively for propelling the low temperature gas so as to cause it to circulate in a substantially horizontal circuitous path in a direction transverse to the path of travel of said goods under guidance of said second partition means and said wall means placed in alignment within both of said cooling and precooling spaces.

2. An apparatus according to claim 1, wherein a plurality of precooling spaces are formed and the low temperature gas in said cooling space is supplied by way of said passages sequentially into each of said precooling space counter to the path of travel of said goods.

3. An apparatus according to claim 2, wherein said conveying means comprises a rotatable endless body mounted in said housing and said wall means comprises plate members secured to an outer surface of said endless body.

4. An apparatus according to claim 2, wherein said conveying means comprises a plurality of trays movable through a tunnel defined by said housing and said trays further include a pusher means serving to transport said goods from an inlet defined in the housing at one end thereof to an exit, adjacent to the opposite end of said housing where the goods are discharged therefrom.

5. An apparatus according to claim 4 wherein the trays are arranged vertically within the tunnel.

6. An apparatus according to claim 5 wherein a plurality of pairs of guide rails are laid in the interior of the tunnel in vertical steps and the trays are moved along the pairs of guide rails.

7. An apparatus according to claim 6 further comprising means for soaking the goods transferred from the cooling space into a low temperature liquified gas.

8. An apparatus according to claim 7 further comprising at least one space for uniformalizing temperature of the goods in forced circulating gas flow.

9. An apparatus according to claim 8 further comprising a pipe member for conducting said precooling space and said space for uniformalizing temperature to supply low temperature gas from the precooling space to the space for uniformalizing temperature.

10. An apparatus for cooling goods through contact with a low temperature gas as claimed in claim 1, wherein the upper wall of said housing includes a further recess into which a unitary flow control means is arranged to be retracted from a position cooperative with said conveying means.

* * * * *